United States Patent [19]

Fujiwara

[11] Patent Number: 4,611,939

[45] Date of Patent: Sep. 16, 1986

[54] SHEET FEEDING DEVICE FOR AN IMPACT-TYPE PRINTER

[75] Inventor: Shinsuke Fujiwara, Osaka, Japan

[73] Assignee: NEC Home Electronics Ltd, Osaka, Japan

[21] Appl. No.: 675,321

[22] Filed: Nov. 28, 1984

[30] Foreign Application Priority Data

Nov. 30, 1983 [JP] Japan ..... 58-226290

[51] Int. Cl.[4] ..... B41J 13/02

[52] U.S. Cl. ..... 400/637; 226/187; 271/274; 400/636.3

[58] Field of Search ..... 400/636.3, 637, 637.3, 400/637.4, 636, 638, 637.1, 637.5, 641; 271/273, 274; 226/187, 186

[56] References Cited

U.S. PATENT DOCUMENTS 1,247,456 11/1917 Schwartz ..... 400/636.3
2,005,450 6/1935 Bower ..... 400/636.3 X

FOREIGN PATENT DOCUMENTS 478656 6/1929 Fed. Rep. of Germany ... 400/636.3
56-60285 5/1981 Japan ..... 400/637
215114 5/1924 United Kingdom ..... 400/637

OTHER PUBLICATIONS

"Spring Design to Positively Retain Axle for Pressure Roll System", by Gerhardt, *IBM Technical Disclosure Bulletin*, vol. 19, No. 2, p. 666, 7-1976.

"Platen Backup Rollers", by Ramirez et al, *IBM Technical Disclosure Bulletin*, vol. 25, No. 1, Jun. 1982.

*Primary Examiner*—Edgar S. Burr
*Assistant Examiner*—Moshe I. Cohen
*Attorney, Agent, or Firm*—Cushman, Darby & Cushman

[57] ABSTRACT

A sheet feeding device in an impact-type printer, in which a leaf spring member is provided below a platen which is in confronting relationship with printing heads. The pressure rollers are rotatably mounted on the leaf spring member while a cam surface is defined on one of the guide shafts which mounts the printing mechanism for reciprocal movements along the platen. The leaf spring member at one end engages the cam surface so that it is flexibly displaced with respect to the platen in response to rotation of the guide shaft so as to move the pressure rollers towards or away from the platen.

7 Claims, 6 Drawing Figures

SHEET FEEDING DEVICE FOR AN IMPACT-TYPE PRINTER

CROSS-REFERENCE TO RELATED APPLICATIONS

This application is related to commonly-owned U.S. application Ser. No. 675,327, now abandoned, to Agata filed even date herewith, the entire disclosure thereof being expressly incorporated hereinto by reference as is the underlying priority document herein Japanese Application No. 58-226290 filed Nov. 30, 1983.

BACKGROUND OF THE INVENTION

The present invention relates to a sheet feeding device for an impact-type printer with a platen. More particularly, the present invention relates to means for causing pressure rollers of the sheet feeding device to be displaced into and out of pressing engagement with the platen of an impact-type printer.

A conventional sheet feeding device in an impact-type printer is shown in FIG. 1. As can be seen, impact-type printers conventionally include a platen 1 and a paper guide 2 for guiding a printing sheet A along the cylindrical exterior surface of the platen 1. A crank arm 3 is positioned below the paper guide 2 in such a manner that it is pivotal about a shaft 4. The crank arm 3 is in slidable contact with a cam roller 6 which is positioned at one end of a lever 5, the latter being pivotal abaout shaft 5*a*. Therefore, as the lever 5 pivots about shaft 5*a* (as indicated by the arrow 5*b* in FIG. 1), the crank arm 3 responsively pivots about shaft 4 as shown by arrow 5*c* in FIG. 1. In such a manner, a pressure roller 7 which is provided at one end of the crank arm 3 is caused to either press against or be displaced from the sheet A on the platen 1 through an opening 8 formed in the paper guide 2 in dependence upon the direction of pivotal movement of lever 5 about shaft 5*a*.

The conventional sheet feeding mechanism described above is disadvantageous in several respects. For example, separate mechanisms are required in order to operate the pressure roller 7 via the crank arm 3, the lever 5 and the cam roller 6. As the pressure roller 7 is operated through a plurality of components, the pressure roller operating structure is disadvantageously large in the number of components, intricate in construction and high in manufacturing cost. In general, the lever 5 and the cam roller 6 are laterally provided relative to the platen 1 so that they do not obstruct the operations of the other components comprising the printer. Therefore, when the pressure roller 7 is urged against the platen 1, the pressure may not be uniform over longitudinal length of the platen.

SUMMARY OF THE INVENTION

In view of the foregoing, an object of this invention is to provide a sheet feeding device for a printer in which the pressure rollers can be uniformly pressed against the platen, and which reduces the number of components needed for proper sheet-feeding operation which thus leads to a more simplified construction and lower manufacturing cost.

The sheet feeding device for an impact-type printer in accordance with the present invention preferably includes pressure rollers rotatably mounted to a flexible leaf spring member provided below the platen. A cylindrical shaft to movably mount print heads in confronting relationship with the platen defines a planar cut portion which, together with the cylindrical surface of the shaft, establishes a cam surface. One end portion of the leaf spring member is supported by the cut portion so that when the guide shaft rotates, the leaf spring member is flexibly displaced upwardly with respect to the platen thereby causing the pressure rollers to press against the platen due to the transition between the substantially planar surface of the cut portion and the cylindrical outer surface of the shaft.

According to the present invention, one of the guide shafts for supporting the printing mechanism also functions as part of the structure for pressing the pressure rollers against the platen. Accordingly, the number of components of the device is greatly reduced as compared to the number of components needed in conventional sheet-feeding devices. The leaf spring member can be readily formed and assembled into the device of the present invention merely by placing it on the guide shaft below the platen. Therefore, the sheet feeding device of the present invention can be readily assembled thereby lowing manufacturing cost.

In the device of the present invention, the leaf spring member extends longitudinally relative to the platen and thus the pressure rollers mounted on the leaf spring member are uniformly pressed against the platen. Furthermore, the pressure of the pressure rollers is reinforced due to elastic deformation of the leaf spring member which occurs when the pressure rollers are in pressing engagement with the platen. Therefore, the printing sheet is uniformly urged against the platen by the pressure rollers as to achieve positive feed of the paper sheet which avoids skewing of the sheet upon feeding.

Further aspects and advantages of the present invention will become more apparent after careful consideration is given to the following detailed description thereof in conjunction with the accompanying drawings.

BRIEF DESCRIPTION OF THE ACCOMPANYING DRAWINGS

Reference will hereinafter be made to the accompanying drawings wherein like reference numerals throughout the various Figures denote like structural elements and wherein.

DETAILED DESCRIPTION OF THE PREFERRED EXEMPLARY EMBODIMENT

Figure 1:
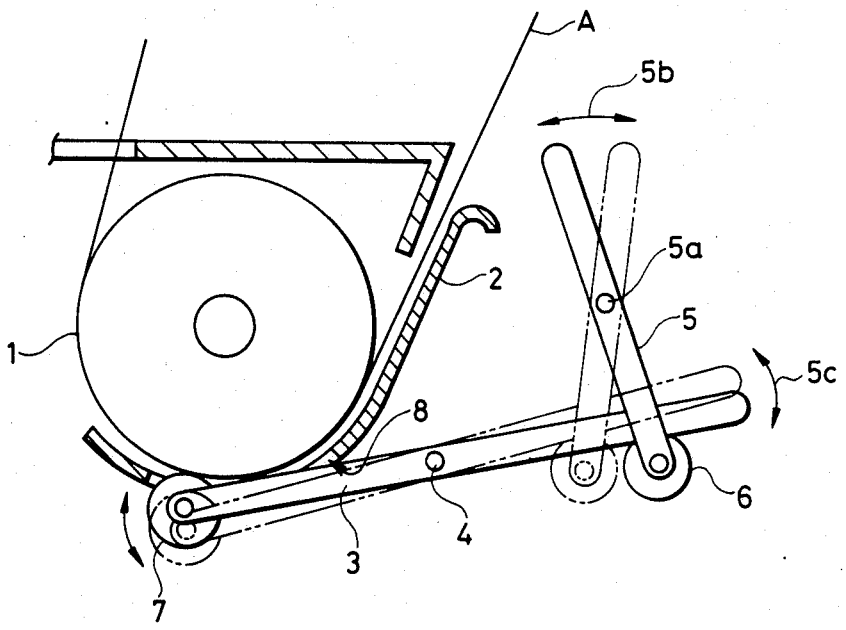
FIG. 1 (PRIOR ART)
FIG. 1 is a side view showing a conventional sheet feeding device for an impact-type printer.
Figure 2:
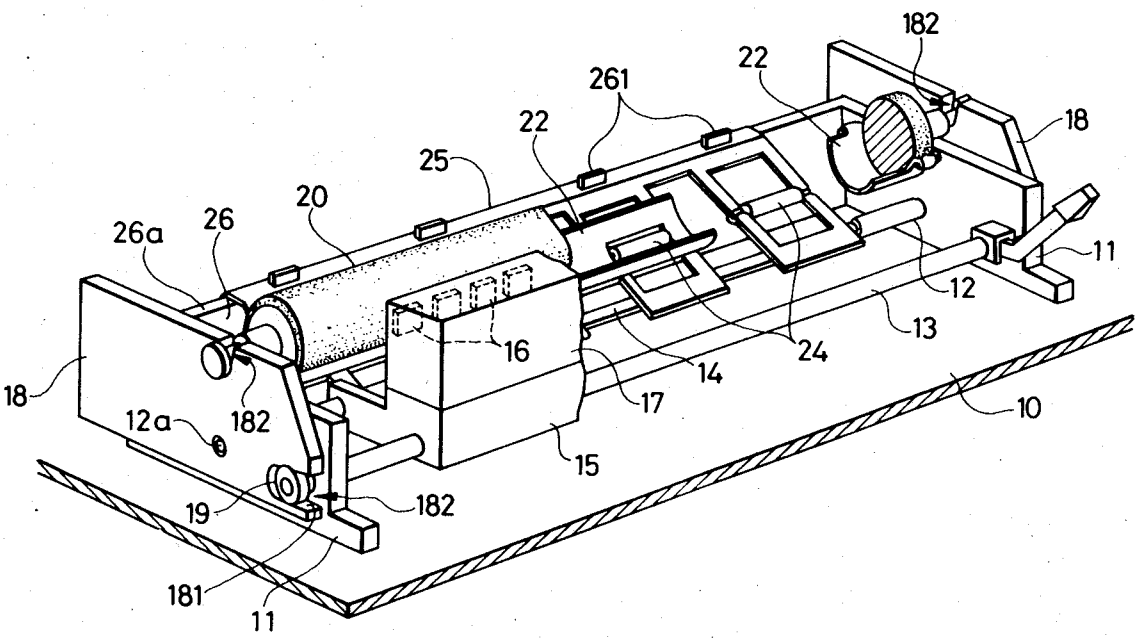
FIG. 2 is a perspective view showing essential components of an impact-type printer in which the present invention is utilized.
Figure 3:
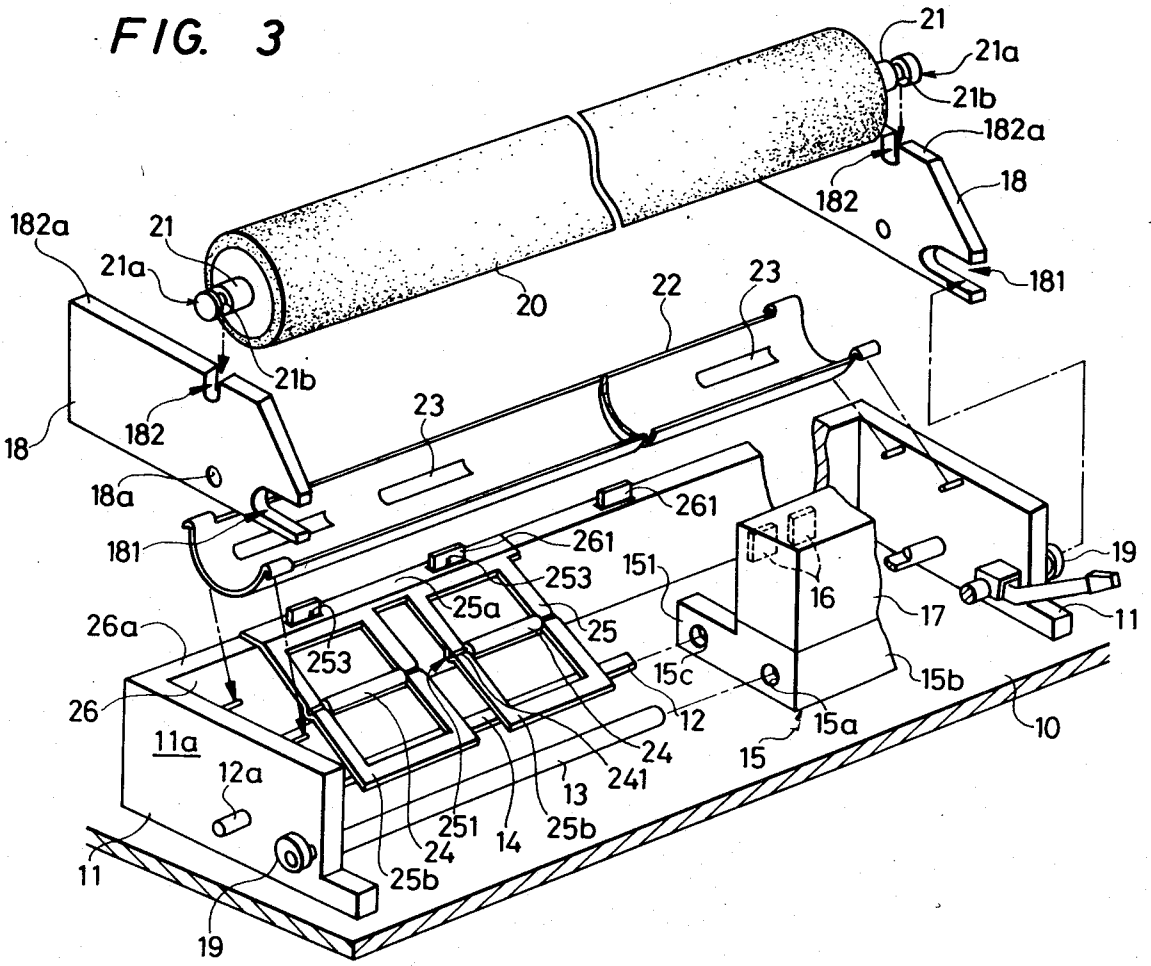
FIG. 3 is an exploded perspective view of the impact-type printer shown in FIG. 2.

As shown in FIGS. 2 and 3, the present invention includes a pair of base frames 11 which are rigidly fixed on a base plate 10 in such a manner that base frames 11 are separated yet in parallel orientation with one another. Parallel adjusting and supporting shafts 12, 13 are provided so as to span the distance between the base frames 11. A planar recessed cut section 14 is defined in the cylindrical outer surface of the adjusting shaft 12 and extends for a predetermined dimension between the base plates 11 in the longitudinal direction of shaft 12. Planar cut section 14 together with the cylindrical outer surface of shaft 12 together define a cam surface, the purpose of which will be described in more detail below.

A head carriage 15 is mounted for reciprocal movement along both of the adjusting shaft 12 and the supporting shaft 13. More specifically, the supporting shaft 13 is inserted into hole 15*a* defined through the body 15*b* of the head carriage 15, while the adjusting shaft 12 is inserted through aligned holes 15*c* formed through a pair of supporting frames 151 which extend from the body 15*b* of the head carriage 15 towards support wall 26. (Only one frame 151 and its corresponding hole 15*c* are shown in FIGS. 2 and 3.) A printing mechanism 17 is fixedly provided on the head carriage 15 and includes a plurality of printing heads 16 arranged in side-by-side fashion in the direction of a printing line upon a printing sheet. The supporting frames 151 are positioned between respective lateralmost ones of leaf spring members 25 (to be described below) and base frame 11.

A pair of side frames 18 are provided on the outer surfaces 11*a* of the base frames 11, respectively. Two end portions 12*a* of the adjusting shaft 12 protrude outwardly from the outer surfaces 11*a* of base frames 11 and are fixedly mated with a respective aperture 18*a* defined substantially at the middle portions of the side frames 18 as shown more clearly in FIG. 2. The side frames 18 define cam grooves 181 which are sized and configured to accept a respective one of the rotatable eccentric cams 19 provided at both ends of the supporting shaft 13. Therefore, as the supporting shaft 13 rotates, the side frames 18 pivot about an axis established by the adjusting shaft 12 through an angle corresponding to the amount of eccentricity of the eccentric cams 19.

A platen 20 is journally supported between the side frames 18 by means of central shaft 21. More specifically, the side frames 18 define receiving grooves 182 respectively formed in the upper edge portions 182*a* thereof. End portions 21*a* of the central shaft 21 longitudinally extend from both ends of the platen 20 and define an annular recess 21*b* registrable with receiving grooves 182 so as to be rotatably supported thereby. Thus, the platen 20 is positioned over the two shafts 12 and 13 by means of the side frames 18 in such a manner that the platen 20 confronts the printing heads 16. As the side frames 18 pivot about the axis established by the adjusting shaft 12 as described above, the platen 20 is responsively moved through an arc so as to be displaced towards or away from the printing heads 16 in dependence upon the direction of pivotal movement of the side frames 18 about shaft 12.

An arcuate paper guide 22 is fixedly held between the base frames 11 and is positioned in such a manner that a gap of predetermined dimension is defined between the platen 20 and the paper guide 22. A printing sheet A (see FIG. 6) is thus insertable into the gap and is arcuately guided along the platen 20 by the paper guide 22. A plurality of slots 23 are formed in the bottom of the paper guide 22 in such a manner that the slots 23 are aligned in the longitudinal direction of the paper guide 22 so as to accept respective ones of a plurality of pressure rollers 24. Thus, a portion of each roller 24 extends through its respective slot 23 so as to press the sheet A against the platen 20. The paper guide 22 may be held between the side frames 18.

Figure 4:
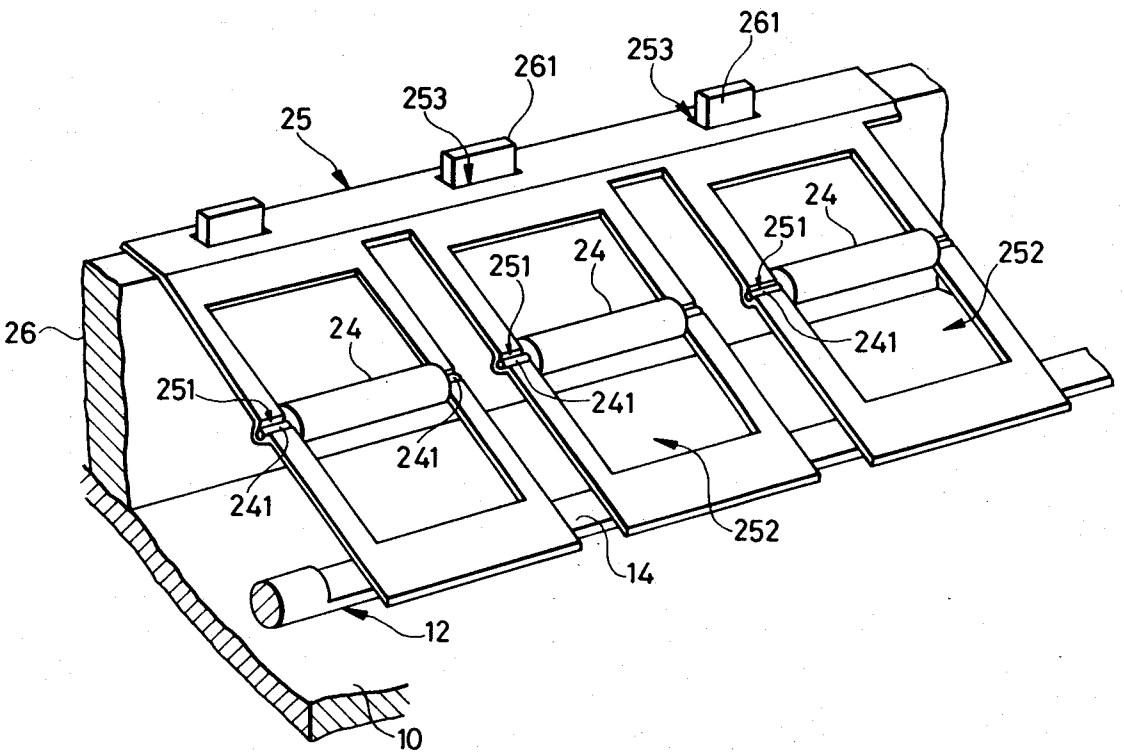
FIG. 4 is a detailed perspective view of a sheet feeding device according to the present invention.

As shown in FIGS. 2–4, the pressure rollers 24 are longitudinally arranged, relative to platen 20, on a respective leaf spring member 25. Each pressure roller 24 has a central shaft 241 rotatably engaged with recesses 251 formed in the leaf spring member 25. The leaf spring member 25 is preferably a rectangular flat plate with the pressure rollers 24 extending across rectangular holes 252 formed in the leaf spring member 25. One side portion 25*a* of the leaf spring member 25 is coupled to the upper edge 26*a* of mounting wall 26 on the base plate 10. The one side portion 25*a* of the leaf spring member 25 is preferably secured to the upper edge 26*a* of the mounting wall 26 by mating engagement between the supporting pieces 261 of wall 26 and mounting holes 253 formed in the one side portion 25*a*. The other side portion 25*b* of the leaf spring member 25 rests upon the recessed cut portion 14 of the adjusting shaft 12.

Therefore, as the adjusting shaft 12 rotates, the leaf spring member 25 is flexibly vertically displaced against its own bias force through an angle corresponding to the step between the cylindrical surface of the shaft 12 and the recessed cut portion 14. In such a manner, the recessed cut portion 14 and the cylindrical surface of shaft 12 establish a cam surface which displaces the pressure rollers 24 into and out of pressing engagement relative to the sheet A on the platen 20 in response to rotation of the shaft 12 in opposite rotational directions, respectively.

Figure 5:
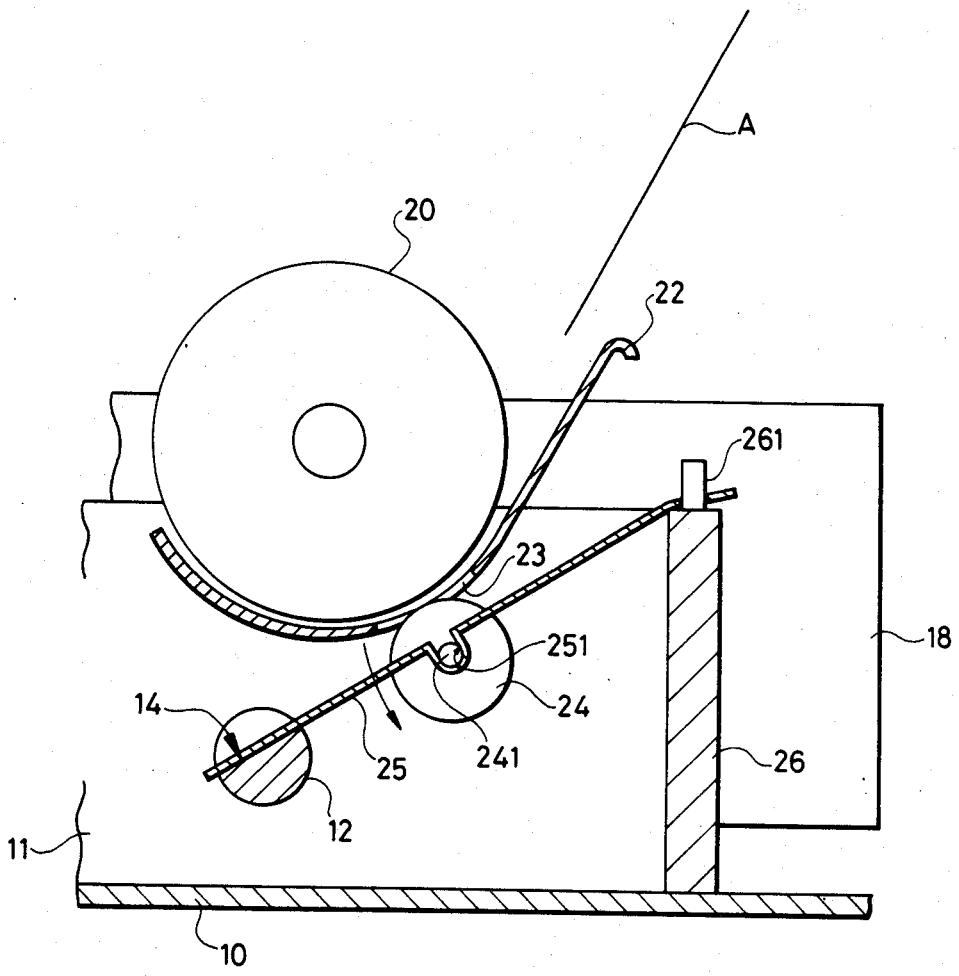
FIGS. 5 and 6 are side views respectively showing disengagement and engagement of the sheet feeding device shown in FIG. 4 relative to a platen.

The sheet A is inserted from above between the platen 20 and the paper guide 22 as shown in FIG. 5 and is held between the platen 20 and the pressure roller 24 as previously described. As the platen 20 rotates about its longitudinal axis established by central shaft 21, the sheet A is respectively moved along the cylindrical surface of the platen 20, guided by the paper guide 22, so that it exits towards the left of platen 20 as viewed in FIGS. 5 and 6. The printing heads 16 of the printing mechanism 17 are then caused to confront printing hammers (not shown), such that the printing heads 16 are selectively hammered to print upon the sheet A on the platen 20.

Figure 6:
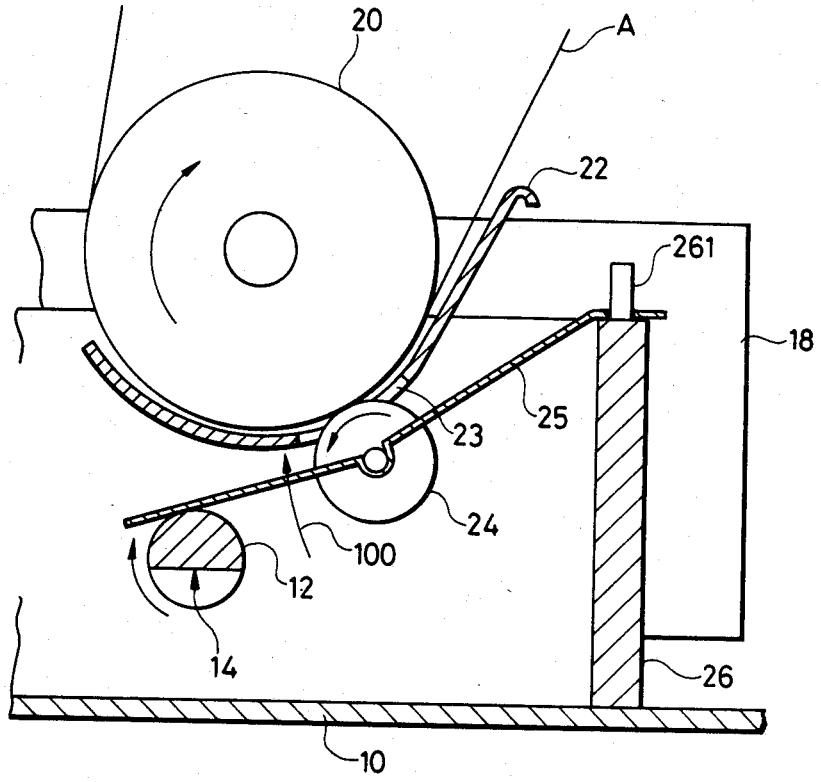

When the other end portion 25*b* of the leaf spring member 25 biasingly rests upon the recessed cut portion 14 of the adjusting shaft 12, the pressure rollers 24 are in spaced-apart relationship relative to the platen 20 as shown in FIG. 5. On the other hand, when the sheet A is inserted between the platen 20 and the paper guide 22, the adjusting shaft 12 is then rotated through a predetermined angle to responsively cause engagement of the other end portion 25*b* of the leaf spring member 25 to be transferred from the recessed cut portion 14 of the shaft 12 to the cylindrical surface of the shaft 12. As a result, the leaf spring member 25 is upwardly displaced through the angle corresponding to the incremental step distance between the recessed cut portion 14 and the cylindrical surface of the adjusting shaft 12 with the one side portion 25*a* of leaf spring member 25 acting as a fulcrum. As the leaf spring member 25 is upwardly displaced, the pressure rollers 24 are moved as indicated by the arrow 100 in FIG. 6 to press the sheet A against the platen 20 through the openings 23 of the paper guide 22. In this manner, the rotation of the adjusting shaft 12 raises the leaf spring member 25 with uniform pressure and stroke, and therefore the pressure rollers 24 are responsively pressed against the cylindrical surface of the platen 20 under uniform pressure. When the pressure rollers 24 are pushed against the platen 20, the leaf spring members 25 are elastically deformed between end portions 25*a* and 25*b* as can be seen in FIG. 6. The reaction force of this elastic deformation is thus exerted through the pressure rollers 24 towards the platen 20. Accordingly, the pressure of the pressure rollers 24 is reinforced and the pressure rollers 24 are positively biased against the platen 20 due to the resultant elastic deformation of leaf spring members 25 and thus the sheet A can be accurately moved with less skew.

When, under the conditions shown in FIG. 6, the adjusting shaft 12 is again rotated through a predetermined angle, the engagement between the other side portion 25*b* of the leaf spring member 25 and the recessed cut portion 14 of the shaft 12 is reestablished so that the leaf spring member 25 is displaced downwardly under its own bias force to cause the pressure rollers 24 to be moved away from the platen 20 and assume the position as shown in FIG. 5.

In the embodiment described above, the recessed cut portion 14 has been shown as being formed in the cylindrical surface of the adjusting shaft 12 so as to cause displacement of the leaf spring member 25. However, other suitable cam surfaces, such as eccentric or elliptical cams, may be formed on the adjusting shaft 12 to perform similar functions.

What is claimed is:

1. In a printer of the type having a printing mechanism carrying printing heads, first and second guide shafts for mounting said printing mechanism for reciprocal longitudinal movements, said first guide shaft mounted for a pivotal movement about its longitudinal axis, a platen in confronting relationship to said printing heads, and a sheet feeding device for feeding paper sheets along a supply path on the periphery of said platen, the improvement wherein said sheet feeding device comprises:

plural pressure roller means for pressing a paper sheet against said platen;

leaf spring means having one end fixed to said printer and a second end opposite to said one end, said leaf spring means being the sole support for said pressure roller means, said leaf spring means exerting a bias force to bias said roller means into a displaced position wherein said roller means are spaced from said platen, said leaf spring means being displaceable, against said bias force, to move said roller means into a pressing position wherein said roller means are in pressing engagement against said platen to capture a paper sheet therebetween; and cam means associated with said pivotal first shaft and engaging said second end of said leaf spring means, said pressure roller means being supported between said fixed end and the area of engagement of said cam means with said leaf spring means cam means displacing said leaf spring means against said bias force to move said roller means from said displaced position and into said pressing position in response to selective rotation of said first shaft.

2. A printer as in claim 1, wherein said cam means includes means defining a longitudinally recessed cut portion formed in said first guide shaft, wherein said second end of said leaf spring means rests upon said cut portion when said roller means are in said displaced position.

3. A printer as in claim 1, in which said cam means includes means for defining a cam surface formed on said first guide shaft.

4. A printer as in claim 2 wherein said cut portion is substantially planar.

5. A sheet feeding device for use in a printer of the type including a journalled cylindrical platen, said sheet feeding device comprising:

roller means for pressing and capturing a paper sheet against said platen so that journalled movement of said platen causes feeding of said paper sheet along a supply path; a substantially planar leaf spring having one end and a fixed second end opposite said one end, said leaf spring being the sole support for said roller means, said leaf spring biasing said roller means into a first position wherein said roller means is separated from said platen, wherein said leaf spring is flexibly displacable to move said roller means to a second position in pressing engagement with said platen; and rotatable cam means operatively engaged with said one end of said leaf spring, said roller means being supported between said fixed end and the area of engagement of said cam means with said leaf spring said cam means flexibly displacing said leaf spring from said first position to said second position in response to rotation of said cam means.

6. A device as in claim 5 wherein said leaf spring is elastically deformed in the region of said roller means supported thereby between said one and second ends when in said second position, said elastic deformation imparting a force to said roller means in a direction towards said platen to pressingly capture a paper sheet between said platen and said roller means.

7. A sheet feeding device for use in a printer of the type having a journalled cylindrical platen, said device comprising:

a frame for journally supporting said cylindrical platen;

a leaf spring having one end fixed to said frame and having a free end, opposite to said one end, said leaf spring extending transversely below said cylindrical platen;

a pressure roller supported solely by said leaf spring between said one and free ends for rotation about an axis parallel to said cylindrical platen; and rotatable cam means engaged with said free end of said leaf spring for displacing said free end between a first position wherein said leaf spring is spaced from said cylindrical roller and a second position wherein a region of said leaf spring between said first and second ends is elastically deformed to responsively bias said pressure roller into engagement with said cylindrical platen whereby a sheet captured between said pressure roller and said cylindrical roller when said leaf spring is in said second position can be fed along a supply path upon rotation of said cylindrical platen.

* * * * *